US010365614B2

(12) United States Patent
Von Allmen

(10) Patent No.: US 10,365,614 B2
(45) Date of Patent: Jul. 30, 2019

(54) WATCH AND ITEM OF JEWELLERY WITH INTERCHANGEABLE WRISTBAND

(71) Applicant: The Swatch Group Research and Development Ltd, Marin (CH)

(72) Inventor: Jean-Marc Von Allmen, Thun (CH)

(73) Assignee: The Swatch Group Research and Development Ltd, Marin (CH)

( * ) Notice: Subject to any disclaimer, the term of this patent is extended or adjusted under 35 U.S.C. 154(b) by 8 days.

(21) Appl. No.: 15/616,159

(22) Filed: Jun. 7, 2017

(65) Prior Publication Data

US 2018/0011448 A1 Jan. 11, 2018

(30) Foreign Application Priority Data

Jul. 7, 2016 (EP) ..... 16178320

(51) Int. Cl.
*A44C 5/14* (2006.01)
*G04B 37/12* (2006.01)
(Continued)

(52) U.S. Cl.
CPC ..... *G04B 37/1486* (2013.01); *A44C 5/14* (2013.01); *A44C 5/147* (2013.01); *G04B 37/12* (2013.01); *G04B 37/1493* (2013.01); *G04B 37/16* (2013.01); *G04B 37/18* (2013.01); *G04B 47/046* (2013.01)

(58) Field of Classification Search
CPC ..... G04B 37/12; G04B 37/1486; G04B 37/1493; G04B 37/16; G04B 47/046; A44C 5/147; A44C 5/14
See application file for complete search history.

(56) References Cited

U.S. PATENT DOCUMENTS 3,589,341 A * 6/1971 Krebs ..... A01K 27/005 119/865
3,908,243 A * 9/1975 Lou ..... A44C 5/14 24/653
(Continued)

FOREIGN PATENT DOCUMENTS

EP 1 128 237 A1 8/2001
EP 1 128 237 B1 8/2001
(Continued)

OTHER PUBLICATIONS

European Search Report dated Jan. 5, 2017 in European application 16178320.4 filed on Jul. 7, 2016 (with English Translation of Categories Cited Documents).

*Primary Examiner* — Daniel P Wicklund
(74) *Attorney, Agent, or Firm* — Oblon, McClelland, Maier & Neustadt, L.L.P.

(57) ABSTRACT

Watch or item of jewelry including a case or setting including main and secondary slots that enable the fixture of interchangeable removable wristbands including an end link with an end piece with studs arranged to cooperate in a complementary manner with the secondary slots. The link includes a lock with a slide catch arranged to cooperate in a complementary manner and with minimal play with the main slot in a locking position, and the lock further includes a pushbutton operable by a user to move the slide catch away from the main slot and control an unlocking of the lock by retraction of the slide catch by an application of pressure to the pushbutton.

19 Claims, 7 Drawing Sheets

(51) Int. Cl.

| | |
|---|---|
| ***G04B 37/14*** | (2006.01) |
| ***G04B 37/16*** | (2006.01) |
| ***G04B 37/18*** | (2006.01) |
| ***G04B 47/04*** | (2006.01) |

(56) References Cited

U.S. PATENT DOCUMENTS 4,266,326 A * 5/1981 Hong ..... A44C 5/14 224/177
4,432,655 A * 2/1984 Wollman ..... G04B 37/1486 224/164
4,664,533 A * 5/1987 Wollman ..... G04B 37/1486 224/164
8,007,165 B1 * 8/2011 Lalo ..... G04B 37/1486 224/180
9,003,611 B2 * 4/2015 Catanese ..... A44C 5/24 24/71 J
9,949,537 B2 * 4/2018 Hatanaka ..... A44C 5/243
2001/0016971 A1 * 8/2001 Guyard ..... G04B 37/1486 24/365
2005/0207284 A1 * 9/2005 Hiranuma ..... G04B 37/1486 368/282
2007/0067967 A1 * 3/2007 Sima ..... A44C 5/147 24/265 WS
2008/0106980 A1 * 5/2008 Guillaume ..... G04B 37/1486 368/282
2009/0133438 A1 * 5/2009 Stampfli ..... A44C 5/0069 63/3.1
2016/0037876 A1 * 2/2016 Perkins ..... A44C 5/14 224/164
2016/0040698 A1 * 2/2016 Perkins ..... A44B 17/0011 24/664
2016/0069371 A1 * 3/2016 Chen ..... F16B 21/12 403/326
2016/0107694 A1 * 4/2016 Kaneko ..... B62D 21/155 280/784
2017/0045910 A1 * 2/2017 Lee ..... G04B 37/1486
2017/0181510 A1 * 6/2017 Novak ..... A44C 5/147
2018/0125178 A1 * 5/2018 Perkins ..... A44C 5/14

FOREIGN PATENT DOCUMENTS

EP 1 820 415 A1 8/2007
EP 1 820 415 B1 8/2007

* cited by examiner

WATCH AND ITEM OF JEWELLERY WITH INTERCHANGEABLE WRISTBAND

This application claims priority from European Patent Application No. 16178320.4 filed on Jul. 7, 2016; the entire disclosure of which is incorporated herein by reference.

FIELD OF THE INVENTION

The invention relates to an end link of a wristband for a watch or item of jewellery for removable fitting of a watch case, which to receive a said link comprises at least one secondary transverse slot, wherein said case comprises at least one main longitudinal slot delimited by two main support surfaces parallel to a main plane and said link comprises an end piece, which itself comprises for its fixture to said case at least one complementary stud arranged to cooperate in a complementary manner and with minimal play with one said secondary slot, and said link comprises at least one lock, wherein said lock comprises a slide catch arranged to cooperate in a complementary manner and with minimal play with said main slot in a locking position, towards which said slide catch is moved by elastic restoring means belonging to said lock, this comprising intrinsic unlocking means arranged to be operated directly by a finger of a user to move said slide catch away from said main slot of said case.

The invention also relates to a wristband comprising at least one such end link.

The invention also relates to a watch comprising a watch case, which to receive at least one such link comprises at least one secondary transverse slot, wherein said case comprises at least one main longitudinal slot delimited by two main support surfaces parallel to a main plane and comprising at least one such end link.

The invention also relates to an item of jewellery comprising a jewel setting, which to receive at least one such link comprises at least one secondary transverse slot, wherein said case comprises at least one main longitudinal slot delimited by two main support surfaces parallel to a main plane and comprising at least one such end link.

The invention concerns the fields of clock-making and jewellery making and more specifically wristbands for watches and items of jewellery.

BACKGROUND OF THE INVENTION

Watches and items of jewellery are items of elegance, fashion, prestige or luxury personalised for their users through their wristbands. This personalisation relates both to the length and the comfort of the wristbands, their opening and closing mechanism, their structure, material, appearance, colouration, brilliance, decoration. The changing of wristbands is generally entrusted to professionals, which means that a watch or an item of jewellery must often be paired virtually permanently with its wristband.

However, interchangeable wristband systems do exist. The most secure ones have a mechanical locking mechanism and require the use of a tool to perform work on the watch or the jewellery and/or the wristband: this work is not always easy to perform for an ordinary user, who will not always have the required tool to hand at the opportune moment. Numerous other systems comprise clip-on components, the wristband is simply snapped into the watch case or jewel setting and the risk of accidental disengagement, and therefore loss of the item, is increased.

Document US 2005/207284 A1 in the name of Hiranuma Haruki, SEIKO, describes a wristwatch comprising a band connection element having a connection groove, which opens towards a back face, and an end face. The interior of the groove is wider than the free end of the end face. The connection element has an engagement groove, which opens into the connection groove. One end of the wristband has an adapter with a complementary shape to that of the connection groove and is removable in relation thereto. The adapter has an attachment element that can be inserted into or removed from an attachment groove to hold the adapter in position with the connection groove or to separate it therefrom. Fixed to this adapter is a manipulation element comprising a manipulation part at the level of the back face of the connection element. The attachment element is connected to the manipulation element to perform the attachment or separation.

SUMMARY OF THE INVENTION

The invention proposes to develop a simple and safeguarded interchangeable wristband system for a watch or item of jewellery that requires neither a tool or special expertise and is accessible to any user at a moderate cost for modifying watch cases or jewel settings and at a likewise moderate cost for the assembly and locking mechanisms.

For this, the invention relates to a wristband end link according to claim 1.

The invention also relates to a wristband comprising at least one such link.

The invention also relates to a watch comprising a watch case, which to receive at least one such link comprises at least one secondary transverse slot, wherein said case comprises at least one main longitudinal slot delimited by two main support surfaces parallel to a main plane and comprising at least one such end link.

The invention also relates to an item of jewellery comprising a jewel setting, which to receive at least one such link comprises at least one secondary transverse slot, wherein said setting comprises at least one main longitudinal slot delimited by two main support surfaces parallel to a main plane and comprising at least one such end link.

BRIEF DESCRIPTION OF THE DRAWINGS

Other features and advantages of the invention will become clearer on reading the following detailed description with reference to the attached drawings, wherein.

DETAILED DESCRIPTION OF THE PREFERRED EMBODIMENTS

Figure 1:
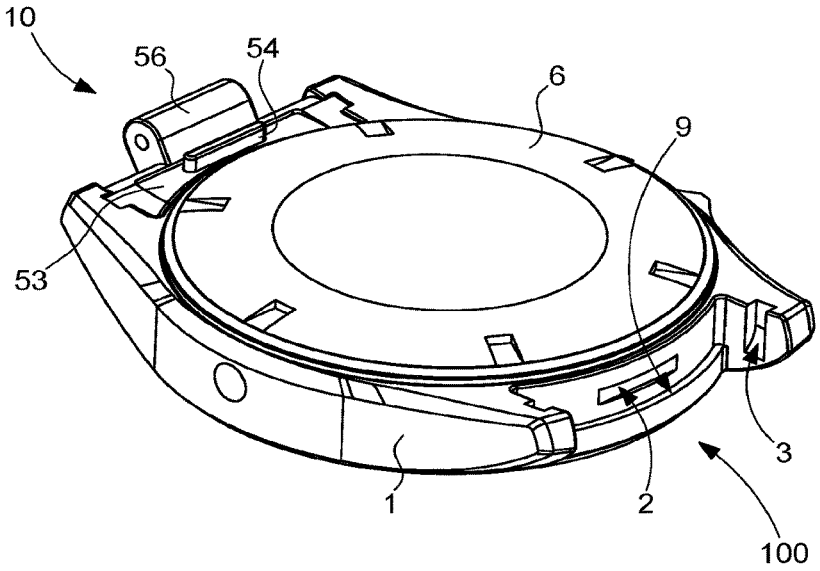
FIG. 1 is a schematic perspective view from above of a case of a watch according to the invention arranged to receive end links according to the invention on two opposing sides and between horns here belonging to the case, such a link being represented in a position inserted and locked into the watch case.
Figure 4:
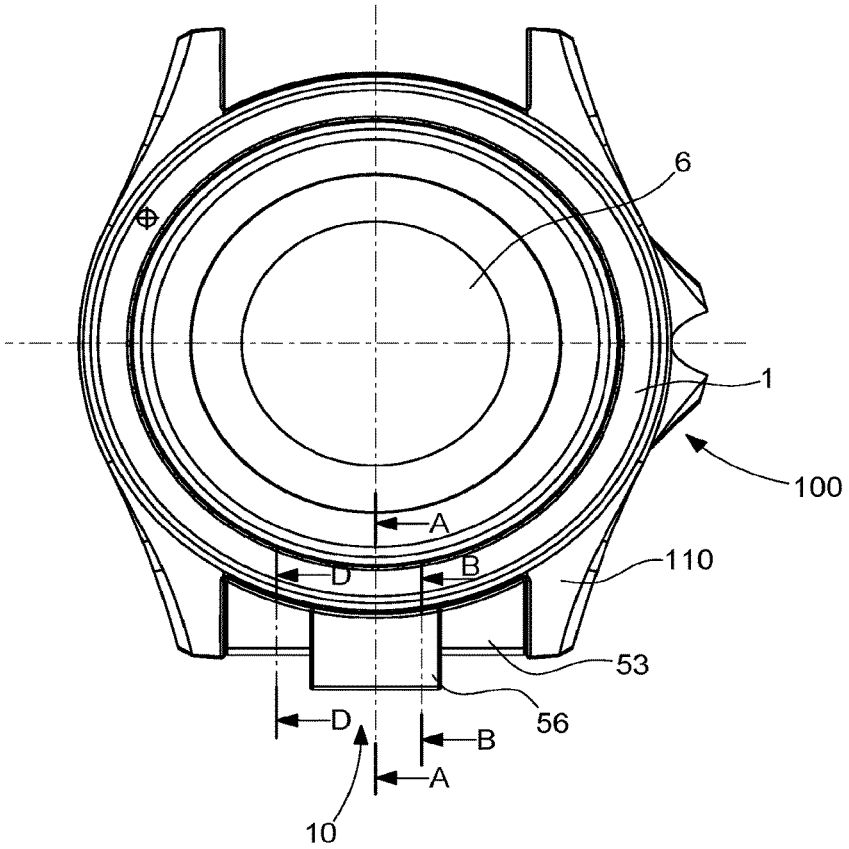
FIG. 4 is a schematic plan view from below of the same assembly fitted with a case base in a locked stop position with section zones of the following figures marked.

The invention proposes to give the user the possibility of easily and securely changing the wristband fitted to his/her watch with the least possible alteration to the watch case from a respective collection in order to retain the appearance of the front face and the rim of the watch, and also proposes a watch with interchangeable wristband for the lowest possible differential production cost.

It must be possible to change the wristband without any tool and without delicate handling while allowing both a radical and fast change between a leather wristband and a linked metal wristband, for example, or also allowing the wristband to be matched to items of clothing and/or jewellery worn by the user or to the complexion of the user, in accordance with the circumstances of use of the watch. The interchangeable wristband also enables wristbands of different length to be exchanged instantaneously, which allows retailers and dealers to immediately supply their customers with perfectly suited watches.

The invention also consists in using an interface connection between the watch case and in particular, but not restrictively, the middle part, on the one hand, and the ends of the wristband, on the other. The invention is described more precisely here for the preferred case of watch band end links, which can be produced in series at a manageable cost and need only be joined to a wristband body, but it is also possible to choose a configuration of wristband in a single piece without a separate end piece, and including the functionalities of interchangeability and locking necessary for good function, but naturally at a higher cost price. The person skilled in the art will know how to adapt the arrangement described below for an end link to an entire wristband without the least problem.

The invention thus preferably relates to a watch band end link 10 for a wristband 90 for the removable fitting of a case 1 of a watch 100.

To receive such a link 10, this case 1 comprises at least one so-called transverse secondary slot 3, wherein each is arranged for the insertion of a stud 30 or a pivot or similar belonging to the link 10. This secondary slot 3 is preferably blind so as to limit the path of the stud 30 in this groove in an abutment position.

Figure 2:
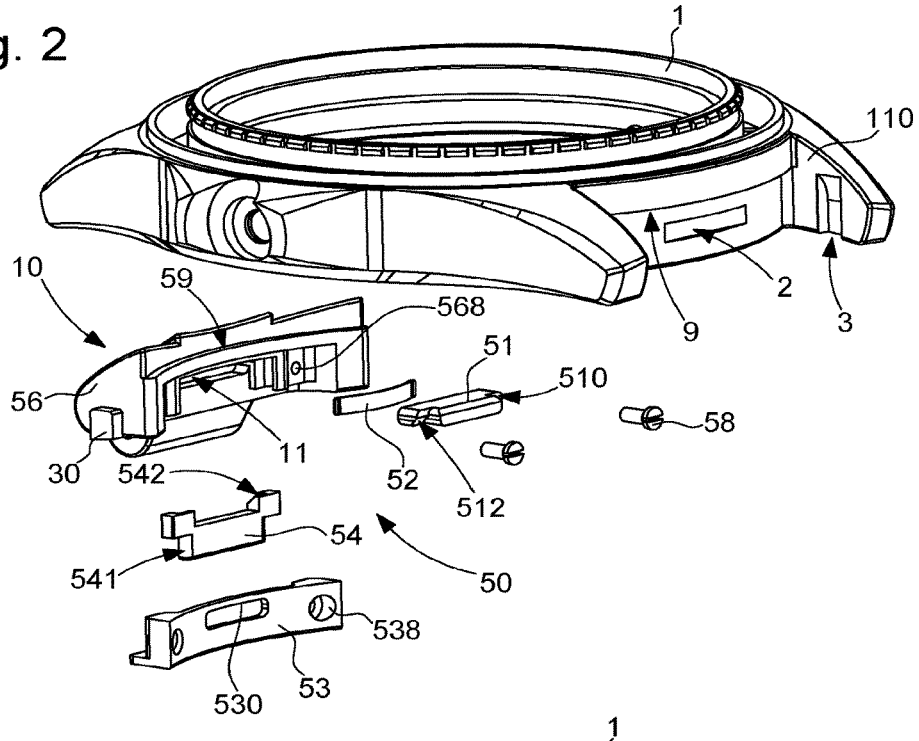
FIG. 2 is a schematic exploded view from above of the case and the link of FIG. 1 without the base of the case.
Figure 3:
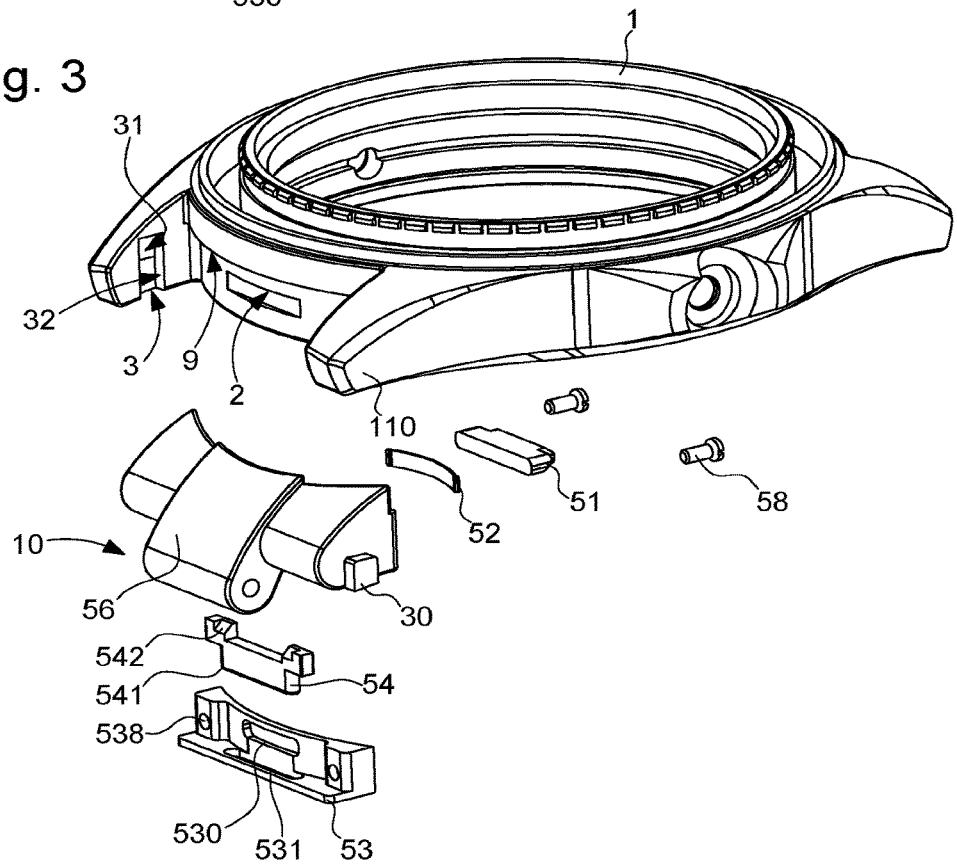
FIG. 3 is a view similar to FIG. 2 of the same assembly viewed from the side of the end link.
Figure 5:
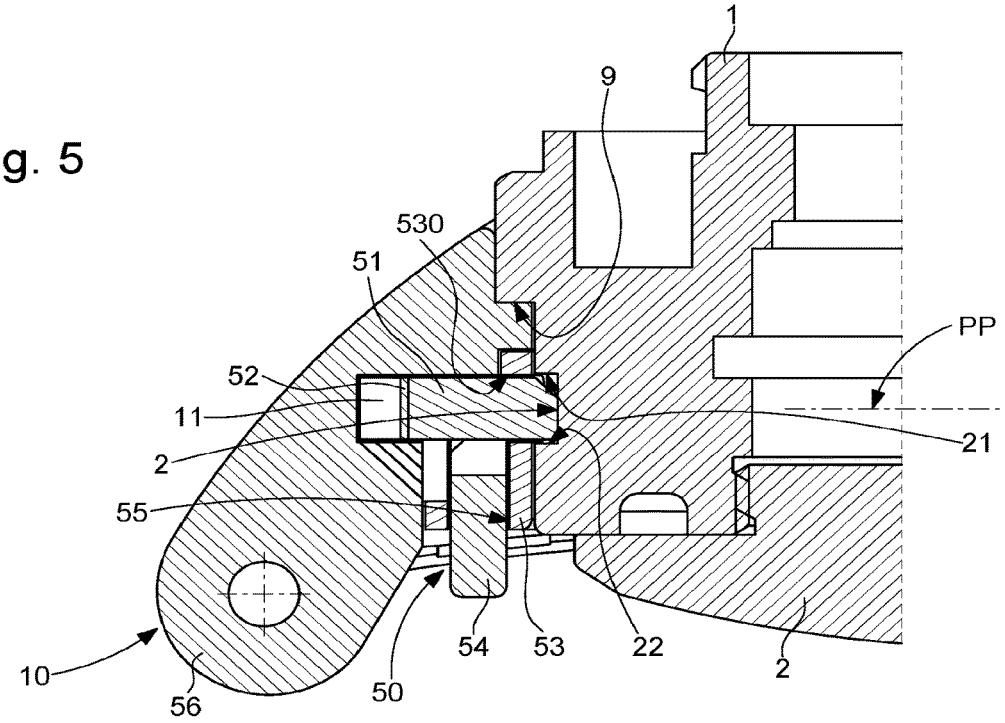
FIG. 5 is a view in partial section of the same assembly taken along a plane perpendicular to the base of the case and along section A-A of FIG. 4.
Figure 13:
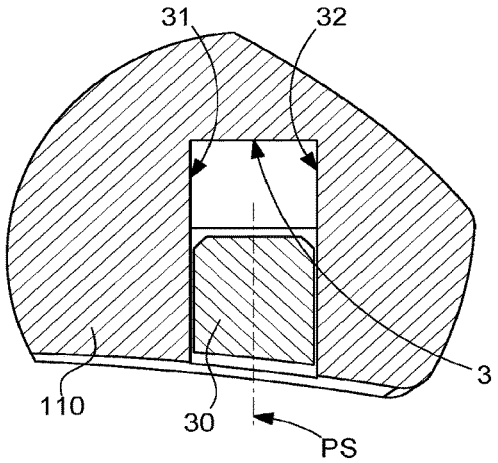
FIG. 13 is similar to FIG. 10 taken along section H-H of FIG. 9.
Figure 14:
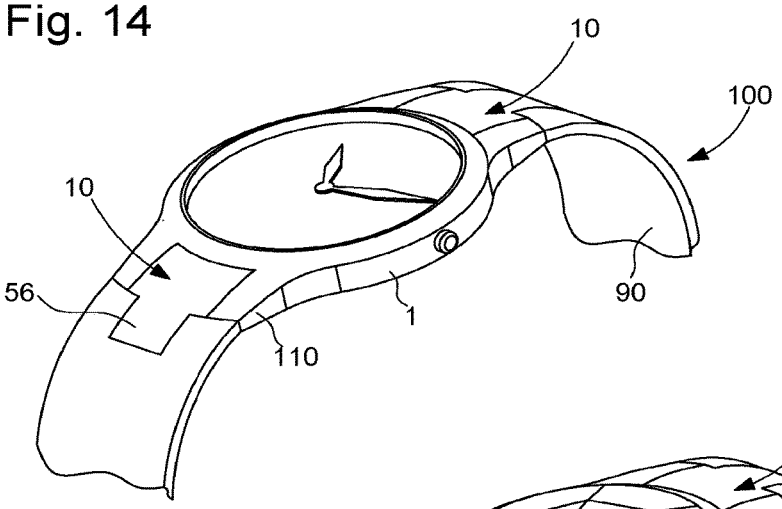
FIG. 14 is a schematic perspective view of a watch according to the invention comprising a wristband according to the invention fitted with two end links according to the invention.
Figure 15:
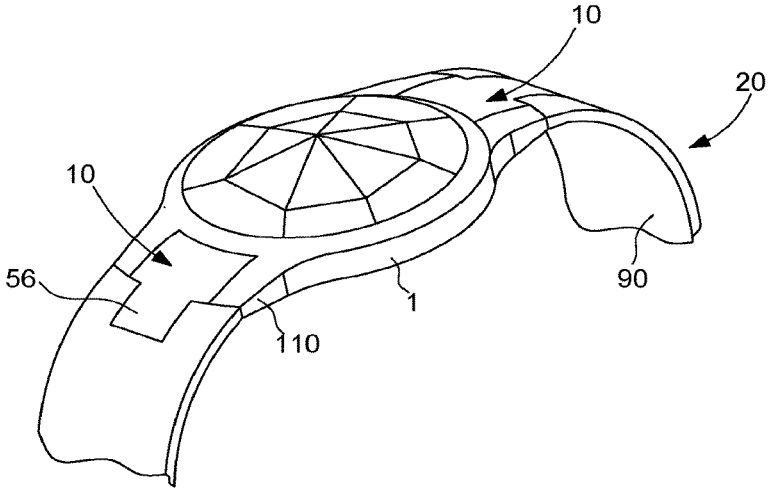
FIG. 15 is a schematic perspective view of an item of jewellery according to the invention comprising a wristband according to the invention fitted with two end links according to the invention.

In a particular non-restrictive case illustrated in the figures, this secondary slot 3 is straight: this is the case in particular when the link 10 carries one or more parallelepipedal studs 30, as can be seen in FIGS. 2, 3 and 13. In another variant that is not illustrated, the second slot 3 can be curved if the stud 30 or equivalent is cylindrical or similar in shape.

In this particular case of straight secondary slot 3, it is more particularly delimited by two secondary support surfaces 31, 32, which are parallel to a secondary plane PS defining a direction of insertion of the link 10.

Each secondary slot 3 is preferably carried by a reinforced zone of the case 1, in particular a horn 11. In fact, it is the connection formed by the secondary slot 3 and the corresponding stud 30 that must have sufficiently broad dimensions to absorb stresses, in particular traction, torsion and accelerations experienced by the wristband and the case 1. The simple insertion of the link 10 into this secondary slot 3, or preferably into these secondary slots 3 that are preferably symmetrical in relation to a plane of symmetry, ensures the interchangeability of the wristbands 90 in relation to the case 1. Similarly, the removal must be designed so that no hindrance is encountered.

To assure the safety function and the insertion of a locking mechanism of the link 10 when its stud 30 or its studs 30 is or are in an abutment position at the bottom of the secondary slot 3, the mechanism comprises a system for locking and unlocking.

For this, the case 1 either has a machined structure, as can be seen from the particular non-restrictive variant illustrated by the figures, or has an attached element that has a particular machined structure.

This particular machined structure preferably comprises at least one main longitudinal slot 2, which is delimited by two main support surfaces 21, 22 parallel to a main plane PP. More particularly, when each secondary slot 3 is straight along a secondary plane PS, the main plane PP intersects with or is orthogonal to this secondary plane PS.

Such a main slot 2 having two parallel faces is very easy to make by turning or by milling. It is preferably located between the horns 11 of the case 1, as can be seen in the figures, and is almost invisible when the link 10 or the wristband 90 is in place. Therefore, for implementation of the invention, it is sufficient that the case 1 comprises the main slot 2 and the secondary slot or slots 3. No other component is necessary at the level of the case 1 that can thus retain all its purity of shape and its usual uses.

The link 10 comprises an end piece 56, which forms the most solid part thereof and which itself comprises, for its insertion into and fixture to the case 1, at least one such complementary stud 30 arranged to cooperate in a complementary manner and with minimal play with a secondary slot 3.

To assure the locking function, the link 10 comprises at least one lock 50.

This lock 50 comprises a slide catch 51, which is arranged to cooperate in a complementary manner and with minimal play with the main slot 2 in a locking position, towards which the slide catch 51 is moved by elastic restoring means 52 belonging to the lock 50.

According to the invention this lock 50 also comprises intrinsic unlocking means arranged to be shifted directly by a finger of a user to move the slide catch 51 away from the main slot 2 of the case 1. Therefore, no tool is necessary to either perform the unlocking or the locking or to perform the insertion or the removal of the link 10 into or from the case 1.

In this regard, while the invention is described in its preferred form where the link 10 comprises a male part cooperating with a female part of the case 1, the reverse configuration is possible without departing from the invention.

More particularly, as illustrated, the slide catch 51 comprises two parallel plane surfaces that are arranged to cooperate in abutment with the main support surfaces 21, 22 of a slot 2 of a case 1, in which slot 2 the slide catch 51 preferably runs with minimal play.

More particularly and as illustrated in the figures, the end piece 56 is symmetrical in relation to a plane of symmetry orthogonal to a plane, along which the slide catch 51 extends.

More particularly, the lock 50 comprises a cover 53 for a front guide of the slide catch 51 close to a main slot 2 forming a latch belonging to the case 1 that receives the link 10. In the figures the slide catch 51 is guided in a first guide 530 belonging to the cover 53. This cover 53 protects the end piece 56, and since it is scarcely visible from the outside, it can be made from a less precious material that is more resistant to wear such as steel or similar than the material forming the end piece 56, which is an external appearance part having a design in harmony with that of the case 1 and often of the same material and with the same finish, wherein this end piece 56 can be made from a gold alloy or similar, for example.

The end piece 56, or indeed the lock 50, also has a back guide chamber 11 of the slide catch 51, wherein this chamber 11 also preferably assures reception of the elastic restoring means 52 illustrated in a non-restrictive manner by a spring blade.

More particularly, the cover 53 is fixed to the end piece 56 by at least one screw 58.

For its operation, according to the invention, the lock 50 preferably comprises a pushbutton 54, which is arranged to be operated by a finger of a user to control an unlocking of the lock 50 by retraction of the slide catch 51 by an application of pressure to this pushbutton 54.

Figure 6:
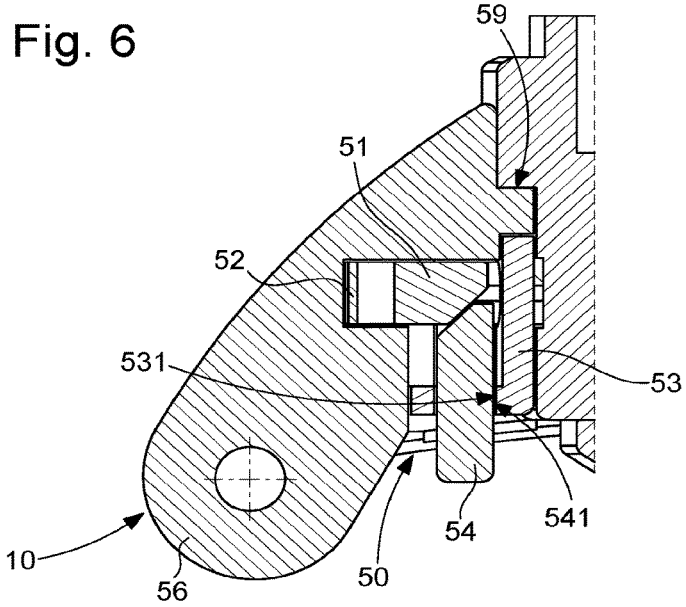
FIG. 6 is similar to FIG. 5 taken along section B-B of FIG. 4.
Figure 7:
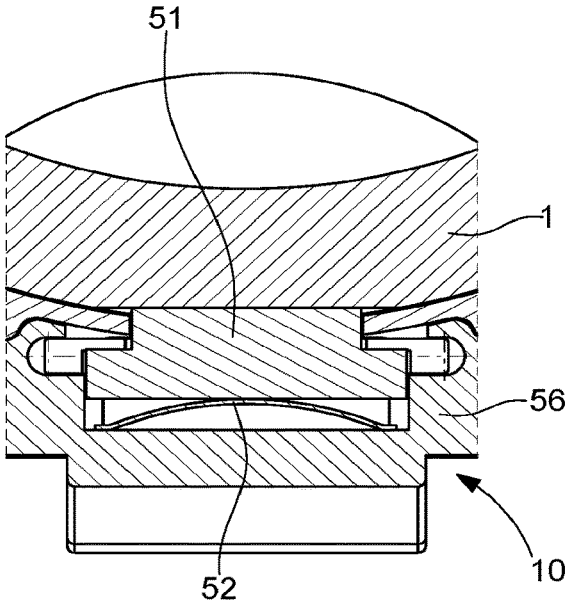
FIG. 7 is similar to FIG. 5 taken along section C-C of FIG. 4.
Figure 8:
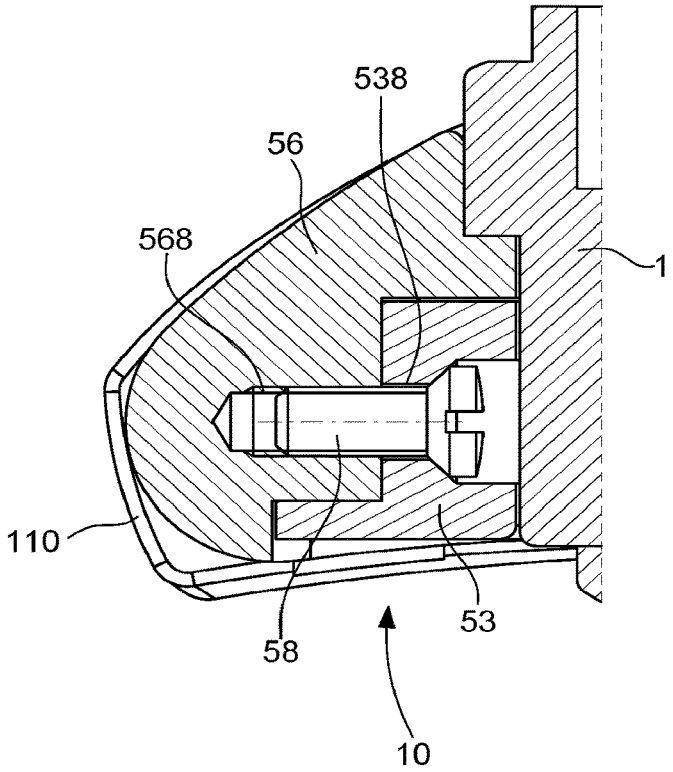
FIG. 8 is similar to FIG. 5 taken along section D-D of FIG. 4.
Figure 9:
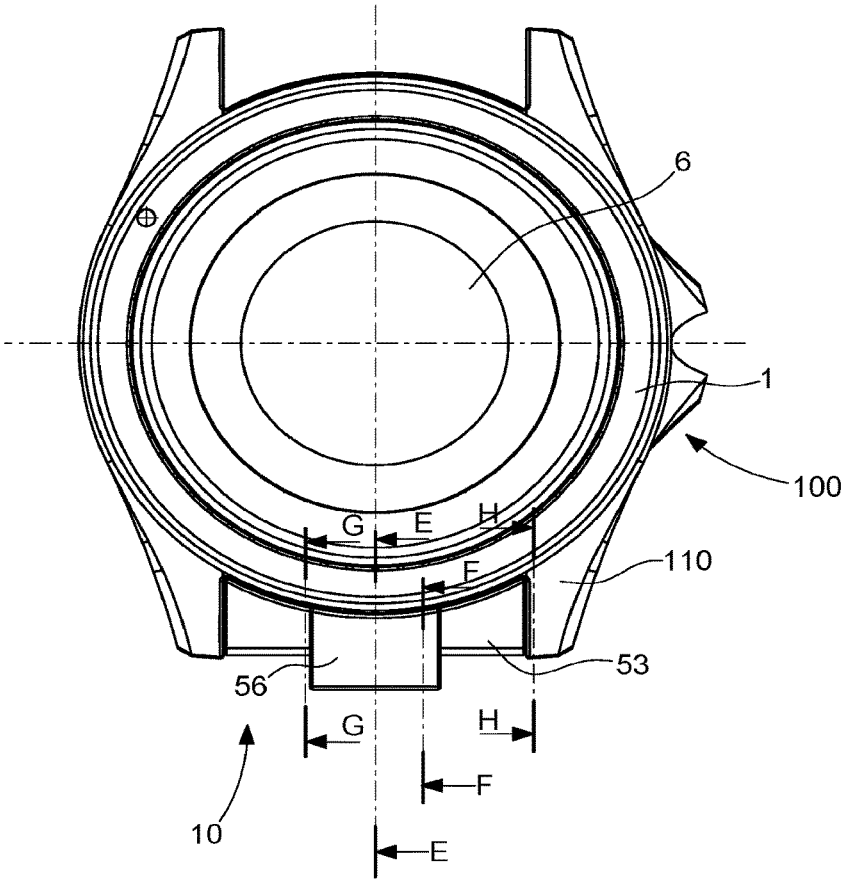
FIG. 9 is a similar view to FIG. 4 of the same assembly in an unlocked stop position with section zones of the following figures marked.
Figure 10:
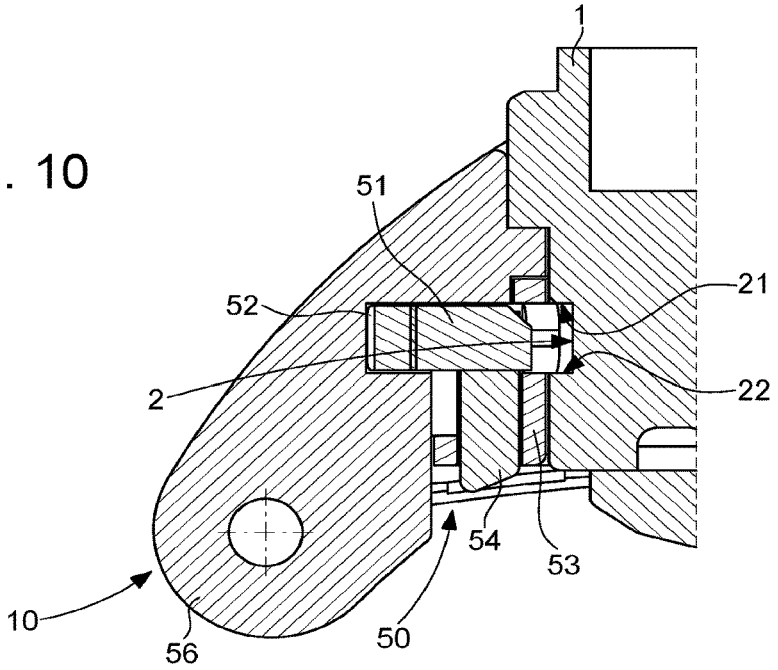
FIG. 10 is a view in partial section of the same assembly taken along a plane perpendicular to the base of the case and along section E-E of FIG. 9.
Figure 11:
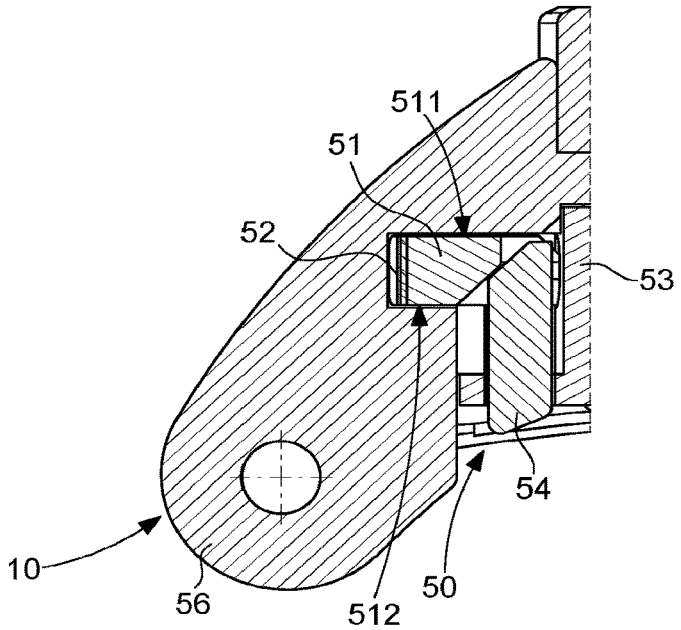
FIG. 11 is similar to FIG. 10 taken along section F-F of FIG. 9.
Figure 12:
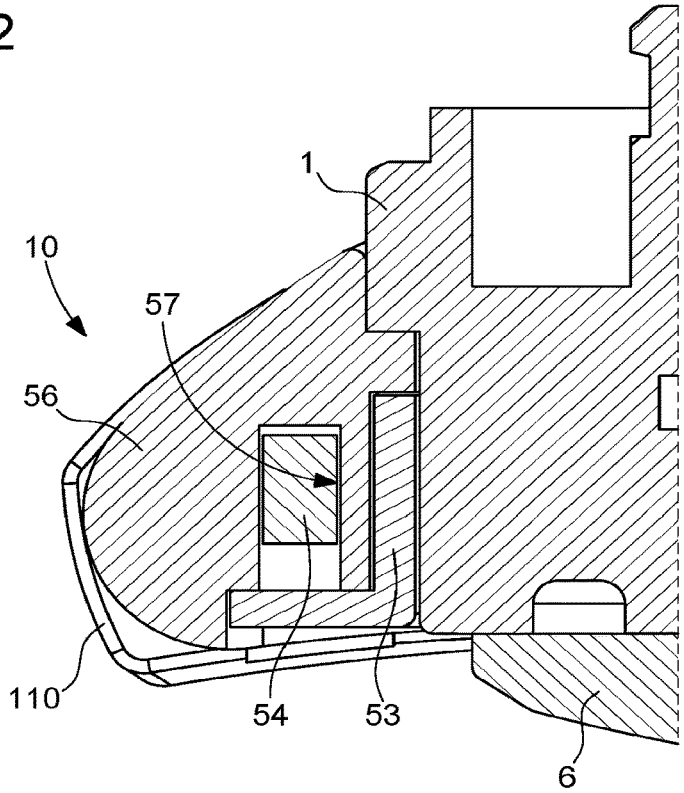
FIG. 12 is similar to FIG. 10 taken along section G-G of FIG. 9.

In an advantageous configuration the pushbutton 54 comprises at least one cam or an oblique bevel 542, which is arranged to cooperate with a complementary cam or a complementary oblique bevel belonging to the slide catch 51, as can be seen in FIGS. 6 and 11.

More particularly, the path of the pushbutton 54 is orthogonal to that of the slide catch 51.

The pushbutton 54 is preferably guided in a second guide 55, in particular a hole 531 belonging to the cover 53 and/or this pushbutton 54 is guided in a third guide 57 belonging to the end piece 56.

The invention also relates to a watch 100 comprising a watch case 1 or jewel setting, which to receive at least one such link 10 comprises at least one secondary transverse slot 3, wherein this case 1 comprises at least one main longitudinal slot 2 delimited by two main support surfaces 21, 22 parallel to a main plane PP, and this watch 100 comprises at least one such wristband end link 10 arranged to cooperate for insertion and locking to its case 1.

More particularly, to receive at least one link 10 the case 1 comprises at least one secondary transverse slot 3 delimited by two secondary support surfaces 31, 32 parallel to a secondary plane PS defining a direction of insertion of the link 10, wherein this secondary plane PS intersects with or is orthogonal to the main plane PP.

More particularly, in a preferred configuration in projection on the main plane PP the secondary support surfaces 31, 32 are remote from the main support surfaces 21, 22.

More particularly, in a preferred configuration in projection on the main plane PP the secondary support surfaces 31, 32 are not aligned with the main support surfaces 21, 22.

In a particular non-restrictive configuration illustrated by the figures the main plane PP is orthogonal to the secondary plane PS.

More particularly, the case 1 has a base 6 parallel to the main plane PP.

In a particular configuration as visible in the figures, the case 1 has a shoulder surface 9 parallel to the main plane PP and a link 10, and preferably each link 10 arranged to cooperate with this case 1, comprises an end piece 56, which has a clamping surface 59 arranged to cooperate by clamping against this shoulder surface 9.

More particularly, the watch 100 comprises at least one removable wristband 90, which at each of its two ends has such a removable end link 10, wherein the links 10 are arranged on both sides of the watch case or jewel setting 1.

More particularly the watch 100 comprises a plurality of such interchangeable removable wristbands 90.

The invention also relates to an item of jewellery 200 comprising a jewel setting 1, which to receive at least one such link 10 comprises at least one secondary transverse slot 3, wherein this setting 1 comprises at least one main longitudinal slot 2 delimited by two main support surfaces 21, 22 parallel to a main plane PP, wherein this item jewellery 200 comprises at least one such wristband end link 10 arranged to cooperate for insertion and locking to the setting 1. All the features described above for a watch case and for a watch band are, of course, applicable to such an item of jewellery 200 and a jewellery wristband.

What is claimed is:

1. An end link of a wristband for a watch or item of jewelry for removable fitting of a watch case or jewel setting, the end link comprising:

an end piece including at least one complementary stud for a fixture to the watch case, the at least one complementary stud being configured to be inserted in at least one secondary transverse slot of the watch case, wherein the watch case includes at least one main longitudinal slot delimited by two main support surfaces parallel to a main plane and the at least one secondary transverse slot delimited by two secondary support surfaces parallel to a secondary plane defining a direction of insertion of the end link; and at least one lock including, a slide catch configured to be inserted in the at least one main longitudinal slot in a locking position, towards which the slide catch is moved by elastic restoring means belonging to said lock, intrinsic unlocking means configured to be operated directly by a finger of a user to move the slide catch away from the main longitudinal slot of the watch case, a pushbutton configured to control an unlocking of the at least one lock by retraction of the slide catch by an application of pressure to the pushbutton imposed by the finger of the user, the pushbutton including at least one cam or an oblique bevel configured to cooperate with a complementary cam or a complementary oblique bevel of the slide catch, and a cover being a front guide of the slide catch close to the main slot forming a latch of the case configured to receive the end piece.

2. The end link according to claim 1, wherein the slide catch includes two parallel plane surfaces configured to cooperate in abutment with the main support surfaces of a the main longitudinal slot of the watch case.

3. The end link according to claim 1, wherein the end piece is symmetrical in relation to a plane of symmetry orthogonal to a plane, along which the slide catch extends.

4. The end link according to claim 1, wherein the end piece includes a back guide chamber of the slide catch configured to receive the elastic restoring means.

5. The end link according to claim 4, wherein the cover is fixed to the end piece by at least one screw.

6. The end link according to claim 4, wherein the pushbutton is guided in a second guide of the cover.

7. The end link according to claim 4, wherein the slide catch is guided in a first guide of the cover.

8. The end link according to claim 1, wherein a path of the pushbutton is orthogonal to a path of the slide catch.

9. The end link according to claim 1, wherein the pushbutton is guided in a third guide of the end piece.

10. A wristband comprising the at least one end link according to claim 1.

11. A watch comprising:

a watch case including at least one secondary transverse slot and at least one main longitudinal slot delimited by two main support surfaces parallel to a main plane; and at least one wristband end link for insertion and locking to the watch case, the at least one wristband end link including an end piece and at least one lock, the end piece including at least one complementary stud being configured to be inserted in the at least one secondary transverse slot of the watch for a fixture, and the at least one lock including a slide catch configured to be inserted in the at least one main longitudinal slot in a locking position, towards which the slide catch is moved by elastic restoring means belonging to said lock, intrinsic unlocking means configured to be operated directly by a finger of a user to move the slide catch away from the main longitudinal slot of the watch case, a pushbutton configured to control an unlocking of the at least one lock by retraction of the slide catch by an application of pressure to the pushbutton imposed by the finger of the user, and a cover being a front guide of the slide catch close to the main slot forming a latch of the case configured to receive the end piece wherein the pushbutton including at least one cam or an oblique bevel configured to cooperate with a complementary cam or a complementary oblique bevel of the slide catch.

12. The watch according to claim 11, wherein the at least one secondary transverse slot is delimited by two secondary support surfaces parallel to a secondary plane defining a direction of insertion of the wristband end link, wherein the secondary plane intersects with or is orthogonal to the main plane.

13. The watch according to claim 12, wherein in projection on the main plane the secondary support surfaces are remote from the main support surfaces.

14. The watch according to claim 12, wherein in projection on the main plane the secondary support surfaces are not aligned with the main support surfaces.

15. The watch according to claim 12, wherein the main plane is orthogonal to the secondary plane.

16. The watch according to claim 11, wherein the watch case includes a base parallel to the main plane.

17. The watch according to claim 11, wherein the watch case includes a shoulder surface parallel to the main plane, and wherein the end piece includes a clamping surface configured to clamp against the shoulder surface.

18. The watch according to claim 11 further comprising at least one removable wristband including the wristband end link at each of two ends of the wristband, wherein the wristband end links are removable and arranged on both sides of the watch case.

19. The watch according to claim 18 further comprising a plurality of removable wristbands, wherein the watch is configured to be interchangeable with the plurality of the removable wristbands.

* * * * *